US008556097B2

(12) United States Patent
Mast et al.

(10) Patent No.: US 8,556,097 B2
(45) Date of Patent: Oct. 15, 2013

(54) CONTAINER HAVING VACUUM PANEL WITH BALANCED VACUUM AND PRESSURE RESPONSE

(75) Inventors: Luke A. Mast, Brooklyn, MI (US); Bradley S. Philip, Tecumseh, MI (US); Pankaj Kumar, Dexter, MI (US); David Downing, Manchester, MI (US)

(73) Assignee: Amcor Limited, Hawthorn (AU)

( * ) Notice: Subject to any disclaimer, the term of this patent is extended or adjusted under 35 U.S.C. 154(b) by 146 days.

(21) Appl. No.: 13/028,244

(22) Filed: Feb. 16, 2011

(65) Prior Publication Data

US 2012/0205341 A1 Aug. 16, 2012

(51) Int. Cl.

| | |
|---|---|
| ***B65D 90/02*** | (2006.01) |
| ***B65D 6/38*** | (2006.01) |
| ***B65D 88/12*** | (2006.01) |

(52) U.S. Cl.

USPC ..... 215/384; 215/381; 215/382; 220/670; 220/673; 220/675

(58) Field of Classification Search

USPC ..... 215/381–384; 220/669–675; D9/516, D9/538

See application file for complete search history.

(56) References Cited

U.S. PATENT DOCUMENTS

| | | | | | |
|---|---|---|---|---|---|
| D69,992 | S | * | 4/1926 | Grannan | D9/538 |
| D97,198 | S | * | 10/1935 | McLaughlin | D9/541 |
| D120,271 | S | * | 4/1940 | Meier, Jr. | D9/553 |
| 3,325,031 | A | * | 6/1967 | Singier | 215/247 |
| D212,322 | S | * | 10/1968 | Koenigsberg | D9/667 |
| D217,590 | S | * | 5/1970 | Koenigsberg | D9/529 |
| 3,536,500 | A | * | 10/1970 | Cleereman et al. | 426/130 |
| 4,805,788 | A | * | 2/1989 | Akiho | 215/381 |
| 4,877,141 | A | * | 10/1989 | Hayashi et al. | 215/381 |
| 5,064,081 | A | * | 11/1991 | Hayashi et al. | 215/373 |
| 5,141,121 | A | * | 8/1992 | Brown et al. | 215/381 |
| 5,178,290 | A | * | 1/1993 | Ota et al. | 215/382 |
| 5,199,588 | A | * | 4/1993 | Hayashi | 215/381 |
| 5,238,129 | A | * | 8/1993 | Ota | 215/381 |
| 5,279,433 | A | * | 1/1994 | Krishnakumar et al. | 215/381 |
| 5,381,910 | A | * | 1/1995 | Sugiura et al. | 215/398 |
| 5,472,105 | A | * | 12/1995 | Krishnakumar et al. | 215/384 |
| D390,114 | S | * | 2/1998 | Young | D9/520 |
| 5,762,221 | A | * | 6/1998 | Tobias et al. | 215/381 |
| D419,872 | S | * | 2/2000 | Lane | D9/434 |
| 6,062,409 | A | * | 5/2000 | Eberle | 215/381 |

(Continued)

FOREIGN PATENT DOCUMENTS

| | | |
|---|---|---|
| EP | 0616949 | 9/1994 |

OTHER PUBLICATIONS

International Search Report and Written Opinion dated Aug. 24, 2012 from corresponding International Patent Application No. PCT/US2012/024999 (six pages).

*Primary Examiner* — J. Gregory Pickett
*Assistant Examiner* — Ned A Walker
(74) *Attorney, Agent, or Firm* — Harness, Dickey & Pierce, P.L.C.

(57) ABSTRACT

A container having a finish, a sidewall portion extending from the finish, a base portion extending from the sidewall portion and enclosing the sidewall portion to form a volume therein for retaining a commodity, and a panel area disposed in the sidewall portion. The panel area includes a belt land portion and a pair of inset portions in mirrored arrangement relative to the belt land portion, and a generally oval boundary area surrounding and containing the belt land portion and inset portions.

8 Claims, 6 Drawing Sheets

(56) References Cited

U.S. PATENT DOCUMENTS

| | | | | | |
|---|---|---|---|---|---|
| D433,946 | S | * | 11/2000 | Rollend et al. | D9/538 |
| D450,595 | S | * | 11/2001 | Ogg et al. | D9/537 |
| 6,347,717 | B1 | * | 2/2002 | Eberle | 215/381 |
| D467,505 | S | * | 12/2002 | Iizuka et al. | D9/538 |
| D470,772 | S | * | 2/2003 | Egger | D9/537 |
| 6,513,669 | B2 | * | 2/2003 | Ozawa et al. | 215/381 |
| 6,550,627 | B2 | * | 4/2003 | Elich et al. | 215/384 |
| 6,616,001 | B2 | * | 9/2003 | Saito et al. | 215/381 |
| D482,976 | S | * | 12/2003 | Melrose | D9/537 |
| 6,830,158 | B2 | * | 12/2004 | Yourist | 215/381 |
| D505,077 | S | * | 5/2005 | Piccioli et al. | D9/538 |
| 6,920,992 | B2 | * | 7/2005 | Lane et al. | 215/381 |
| 6,932,230 | B2 | * | 8/2005 | Pedmo et al. | 215/381 |
| D510,034 | S | * | 9/2005 | Hong et al. | D9/645 |
| 6,981,604 | B2 | * | 1/2006 | Iizuka et al. | 215/381 |
| 7,014,056 | B2 | * | 3/2006 | Trude | 215/381 |
| 7,017,763 | B2 | * | 3/2006 | Kelley | 215/383 |
| D528,427 | S | * | 9/2006 | Sasaki et al. | D9/541 |
| 7,137,520 | B1 | * | 11/2006 | Melrose | 215/381 |
| 7,165,693 | B2 | * | 1/2007 | Oguchi et al. | 215/381 |
| 7,191,910 | B2 | * | 3/2007 | Deemer et al. | 215/381 |
| D542,666 | S | * | 5/2007 | Trude | D9/551 |
| D544,354 | S | * | 6/2007 | Lankford | D9/516 |
| D546,700 | S | * | 7/2007 | Bourne | D9/552 |
| 7,296,703 | B2 | * | 11/2007 | Lane | 215/384 |
| D559,112 | S | * | 1/2008 | Hyde et al. | D9/538 |
| 7,318,533 | B2 | * | 1/2008 | Kelley | 215/384 |
| D561,037 | S | * | 2/2008 | Boon | D9/539 |
| 7,334,695 | B2 | * | 2/2008 | Bysick et al. | 215/371 |
| D565,416 | S | * | 4/2008 | Lepoitevin | D9/538 |
| D568,164 | S | * | 5/2008 | Dodge et al. | D9/544 |
| D569,733 | S | * | 5/2008 | Dodge et al. | D9/544 |
| 7,438,196 | B2 | * | 10/2008 | Yourist | 215/381 |
| D583,245 | S | * | 12/2008 | Lepoitevin | D9/538 |
| 7,472,798 | B2 | * | 1/2009 | Stowitts | 215/381 |
| D585,746 | S | * | 2/2009 | Dodge et al. | D9/516 |
| D585,747 | S | * | 2/2009 | Dodge et al. | D9/516 |
| D592,964 | S | * | 5/2009 | Kissinger et al. | D9/540 |
| 7,552,833 | B2 | * | 6/2009 | Tsutsui et al. | 215/381 |
| 7,568,588 | B2 | * | 8/2009 | Yourist | 215/381 |
| D599,671 | S | * | 9/2009 | Bourne | D9/538 |
| 7,581,654 | B2 | * | 9/2009 | Stowitts | 215/383 |
| D611,347 | S | * | 3/2010 | Dodge et al. | D9/516 |
| D611,820 | S | * | 3/2010 | Dodge et al. | D9/516 |
| 7,699,182 | B2 | * | 4/2010 | Yourist | 215/381 |
| 7,712,620 | B2 | * | 5/2010 | Nemoto et al. | 215/384 |
| D632,180 | S | * | 2/2011 | Howell et al. | D9/538 |
| D637,495 | S | * | 5/2011 | Gill et al. | D9/538 |
| D637,913 | S | * | 5/2011 | Schlies et al. | D9/538 |
| 7,959,024 | B2 | * | 6/2011 | Pedmo et al. | 215/381 |
| D643,723 | S | * | 8/2011 | Snyder et al. | D9/516 |
| 8,017,065 | B2 | * | 9/2011 | Trude et al. | 264/534 |
| D647,804 | S | * | 11/2011 | Yourist et al. | D9/538 |
| D648,222 | S | * | 11/2011 | Snyder et al. | D9/538 |
| D652,724 | S | * | 1/2012 | Snyder et al. | D9/516 |
| D652,725 | S | * | 1/2012 | Snyder et al. | D9/516 |
| D652,726 | S | * | 1/2012 | Snyder et al. | D9/518 |
| 8,087,525 | B2 | * | 1/2012 | Kelley et al. | 215/379 |
| 8,092,434 | B2 | * | 1/2012 | Harlan et al. | 604/275 |
| 8,113,369 | B2 | * | 2/2012 | Mast et al. | 215/381 |
| 8,162,655 | B2 | * | 4/2012 | Trude et al. | 425/525 |
| 8,186,528 | B2 | * | 5/2012 | Melrose et al. | 215/381 |
| D669,358 | S | * | 10/2012 | Sandoval et al. | D9/538 |
| 2001/0035392 | A1 | * | 11/2001 | Ota et al. | 215/381 |
| 2001/0054597 | A1 | * | 12/2001 | Ozawa et al. | 215/381 |
| 2002/0092821 | A1 | * | 7/2002 | Saito et al. | 215/384 |
| 2002/0148841 | A1 | * | 10/2002 | Elich et al. | 220/669 |
| 2004/0050851 | A1 | * | 3/2004 | Ilzuka et al. | 220/669 |
| 2004/0164045 | A1 | * | 8/2004 | Kelley | 215/373 |
| 2004/0164046 | A1 | * | 8/2004 | Kelley | 215/382 |
| 2005/0035083 | A1 | * | 2/2005 | Pedmo et al. | 215/381 |
| 2005/0045645 | A1 | * | 3/2005 | Tsutsui et al. | 220/669 |
| 2005/0051509 | A1 | * | 3/2005 | Bysick et al. | 215/381 |
| 2005/0067369 | A1 | * | 3/2005 | Trude | 215/381 |
| 2005/0121408 | A1 | * | 6/2005 | Deemer et al. | 215/381 |
| 2006/0054587 | A1 | * | 3/2006 | Oguchi et al. | 215/381 |
| 2006/0180568 | A1 | * | 8/2006 | Lane | 215/384 |
| 2007/0075032 | A1 | * | 4/2007 | Kelley et al. | 215/384 |
| 2007/0235905 | A1 | * | 10/2007 | Trude et al. | 264/523 |
| 2008/0041811 | A1 | * | 2/2008 | Stowitts | 215/381 |
| 2008/0041812 | A1 | * | 2/2008 | Stowitts | 215/384 |
| 2008/0149588 | A1 | * | 6/2008 | Nemoto et al. | 215/384 |
| 2008/0257856 | A1 | * | 10/2008 | Melrose et al. | 215/381 |
| 2010/0000962 | A1 | * | 1/2010 | Lepoitevin et al. | 215/381 |
| 2010/0074983 | A1 | * | 3/2010 | Trude et al. | 425/525 |
| 2010/0155360 | A1 | | 6/2010 | Mast et al. | |
| 2010/0219153 | A1 | * | 9/2010 | Mooney | 215/381 |
| 2010/0219154 | A1 | | 9/2010 | Mooney | |
| 2011/0011825 | A1 | * | 1/2011 | Howell et al. | 215/381 |
| 2011/0204070 | A1 | * | 8/2011 | Pedmo et al. | 220/673 |
| 2011/0226724 | A1 | * | 9/2011 | Deemer et al. | 215/398 |
| 2012/0205342 | A1 | * | 8/2012 | Philip et al. | 215/382 |

* cited by examiner

CONTAINER HAVING VACUUM PANEL WITH BALANCED VACUUM AND PRESSURE RESPONSE

FIELD

This disclosure generally relates to containers for retaining a commodity, such as a solid or liquid commodity. More specifically, this disclosure relates to a container having an optimized vacuum panel design to provide a balanced vacuum and pressure response.

BACKGROUND AND SUMMARY

This section provides background information related to the present disclosure which is not necessarily prior art. This section also provides a general summary of the disclosure, and is not a comprehensive disclosure of its full scope or all of its features.

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where ρ is the density of the PET material; ρa is the density of pure amorphous PET material (1.333 g/cc); and ρc is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

Unfortunately, with some applications, as PET containers for hot fill applications become lighter in material weight (aka container gram weight), it becomes increasingly difficult to create functional designs that can simultaneously resist fill pressures, absorb vacuum pressures, and withstand top loading forces. According to the principles of the present teachings, the problem of expansion under the pressure caused by the hot fill process is improved by creating unique vacuum/label panel geometry that resists expansion, maintains shape, and shrinks back to approximately the original starting volume due to vacuum generated during the product cooling phase. The present teachings further improve top loading functionality through the use of arches and column corners in some embodiments.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
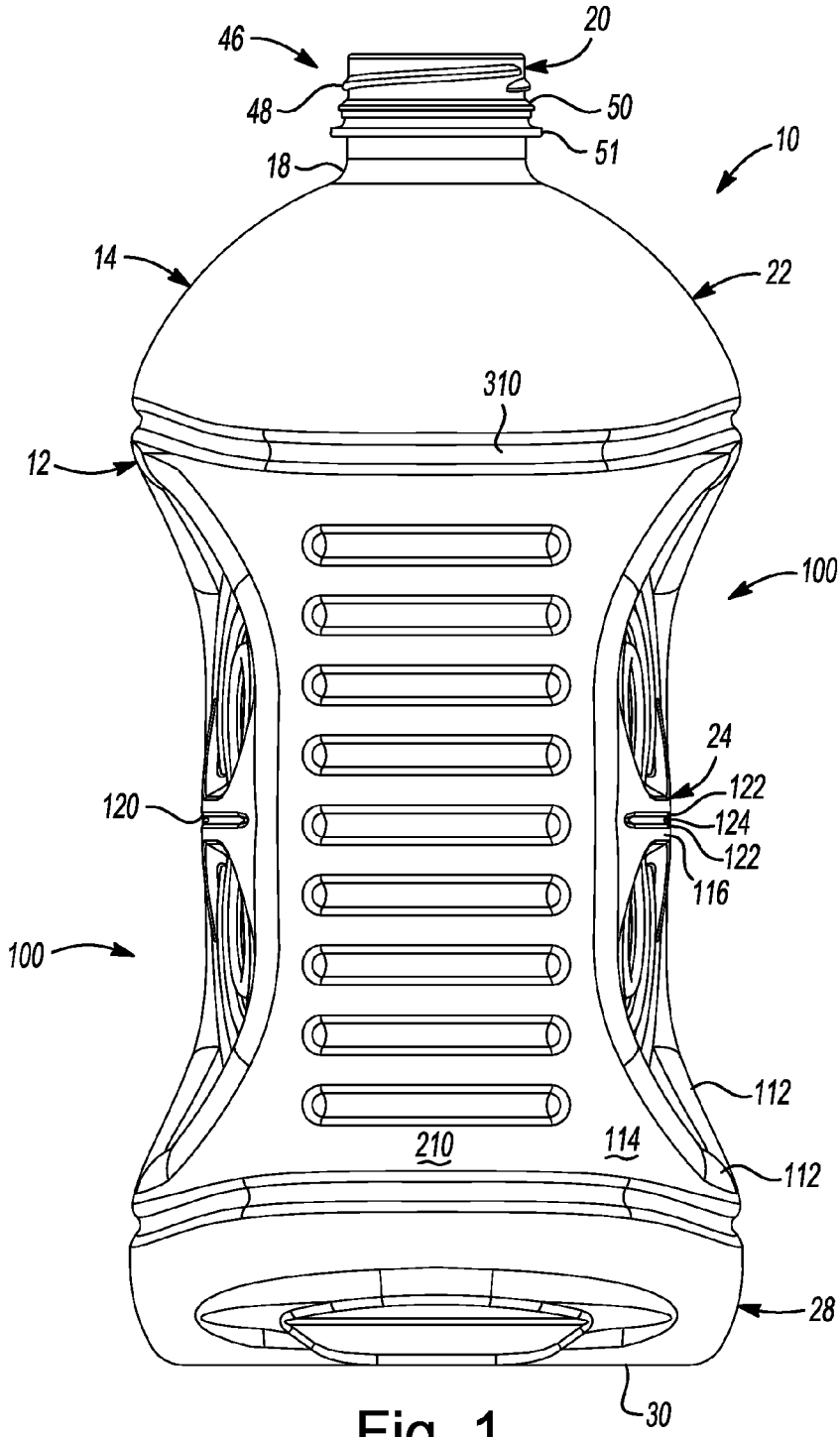
FIG. 1 is a first side view of an exemplary container incorporating the features of the present teachings.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This disclosure provides for a container being made of PET and incorporating a vacuum panel design having an optimized size and shape that resists container contraction caused by hot fill pressure and resultant vacuum and helps maintain container shape.

It should be appreciated that the size and specific configuration of the container may not be particularly limiting and, thus, the principles of the present teachings can be applicable to a wide variety of PET container shapes. Therefore, it should be recognized that variations can exist in the present embodiments. That is, it should be appreciated that the teachings of the present disclosure can be used in a wide variety of containers, including squeezable containers, recyclable containers, and the like.

Accordingly, the present teachings provide a plastic, e.g. polyethylene terephthalate (PET), container generally indicated at 10. The exemplary container 10 can be substantially elongated when viewed from a side and generally cylindrical when viewed from above and/or rectangular in throughout or in cross-sections (which will be discussed in greater detail herein). Those of ordinary skill in the art would appreciate that the following teachings of the present disclosure are applicable to other containers, such as rectangular, triangular, pentagonal, hexagonal, octagonal, polygonal, or square shaped containers, which may have different dimensions and volume capacities. It is also contemplated that other modifications can be made depending on the specific application and environmental requirements.

In some embodiments, container 10 has been designed to retain a commodity. The commodity may be in any form such as a solid or semi-solid product. In one example, a commodity may be introduced into the container during a thermal process, typically a hot-fill process. For hot-fill bottling applications, bottlers generally fill the container 10 with a product at an elevated temperature between approximately 155° F. to 205° F. (approximately 68° C. to 96° C.) and seal the container 10 with a closure before cooling. In addition, the plastic container 10 may be suitable for other high-temperature pasteurization or retort filling processes or other thermal processes as well. In another example, the commodity may be introduced into the container under ambient temperatures.

Figure 2:
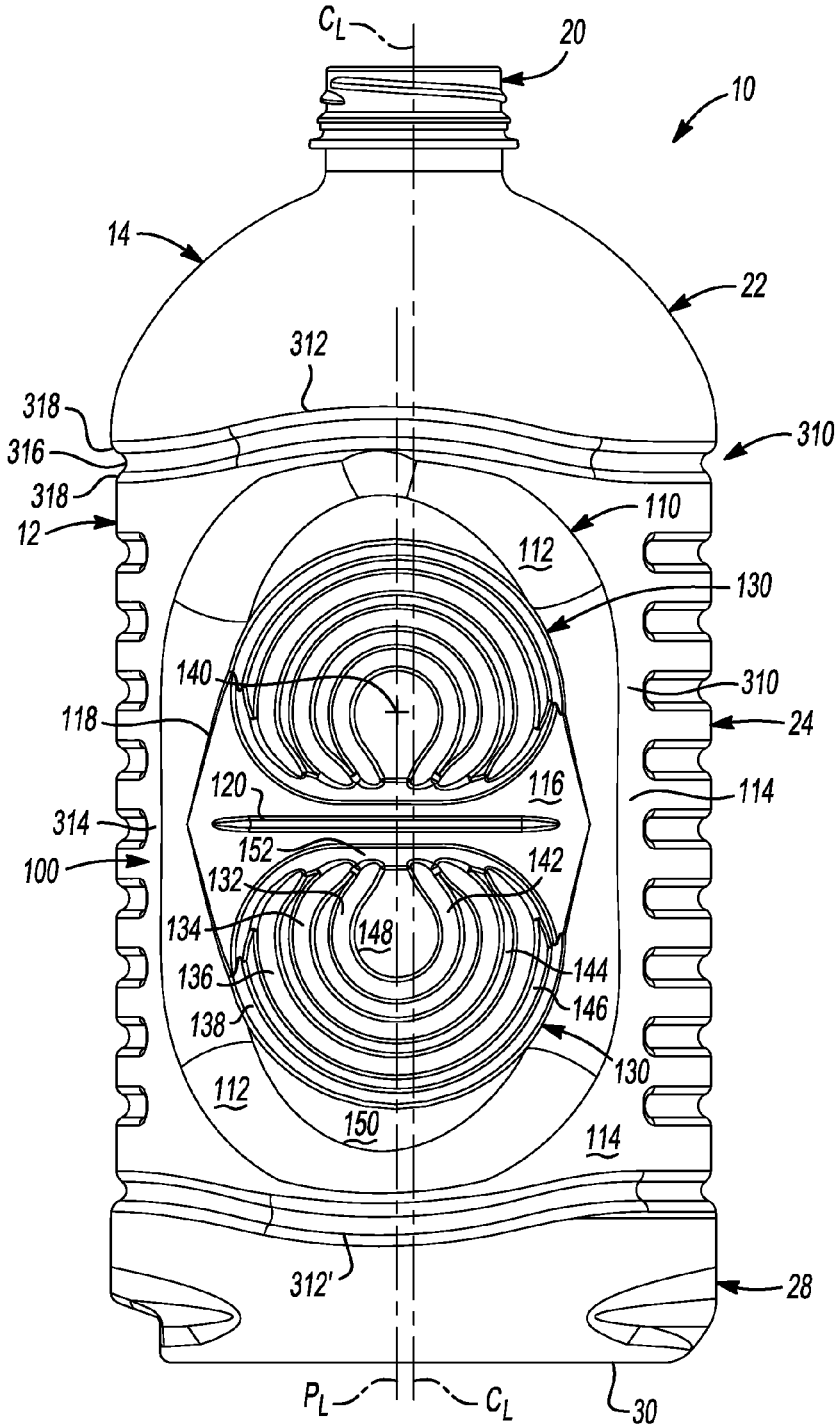
FIG. 2 is a front view of an exemplary container incorporating the features of the present teachings.
Figure 3:
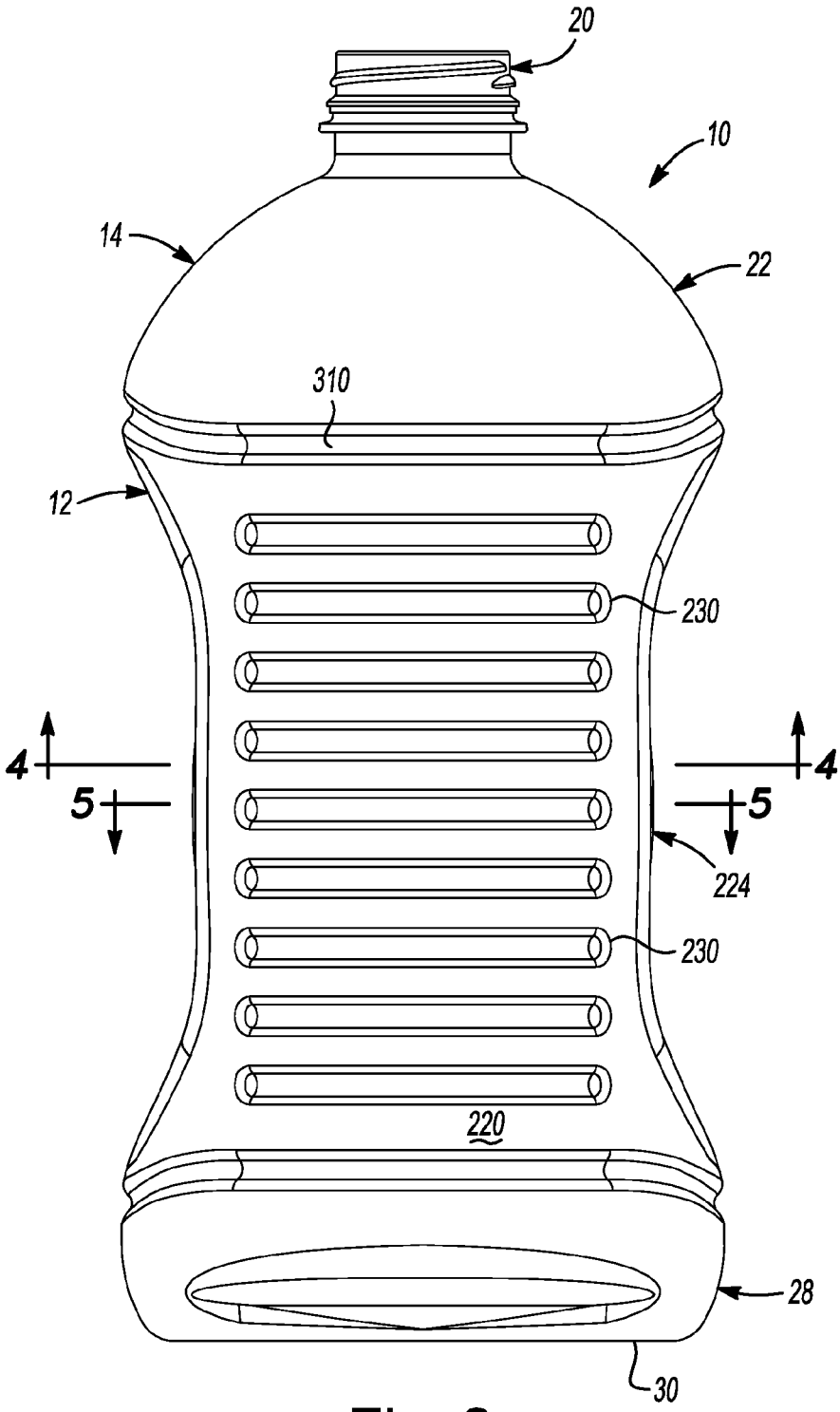
FIG. 3 is a second side view of an exemplary container incorporating the features of the present teachings.
Figure 4:
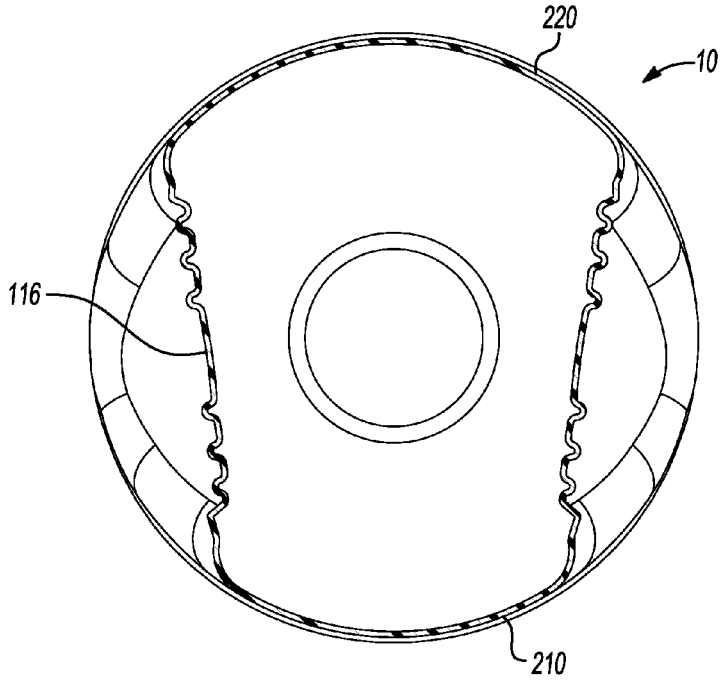
FIG. 4 is a cross-sectional view of an exemplary container incorporating the features of the present teachings taken along line 4-4 of FIG. 3.
Figure 5:
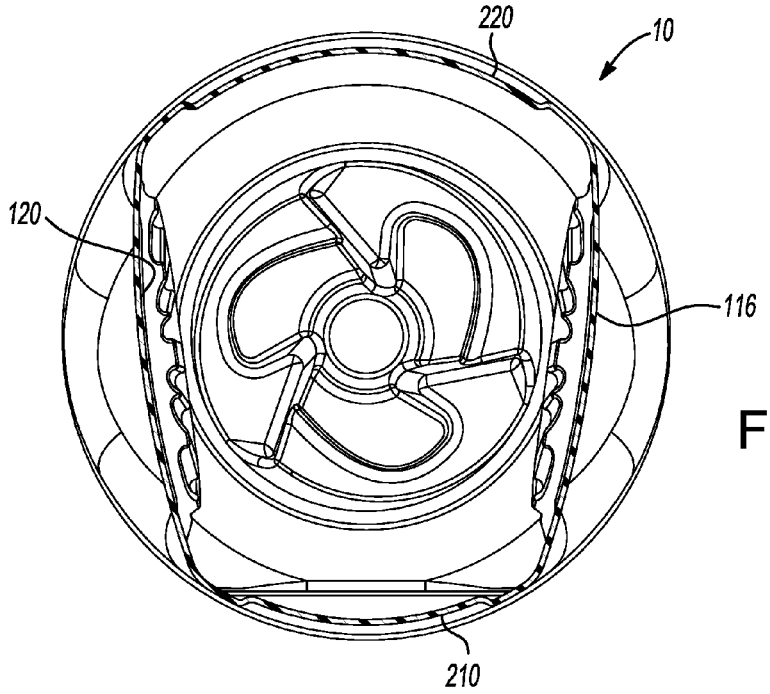
FIG. 5 is a top cross-sectional view of an exemplary container incorporating the features of the present teachings taken along line 4-4 of FIG. 3.
Figure 6:
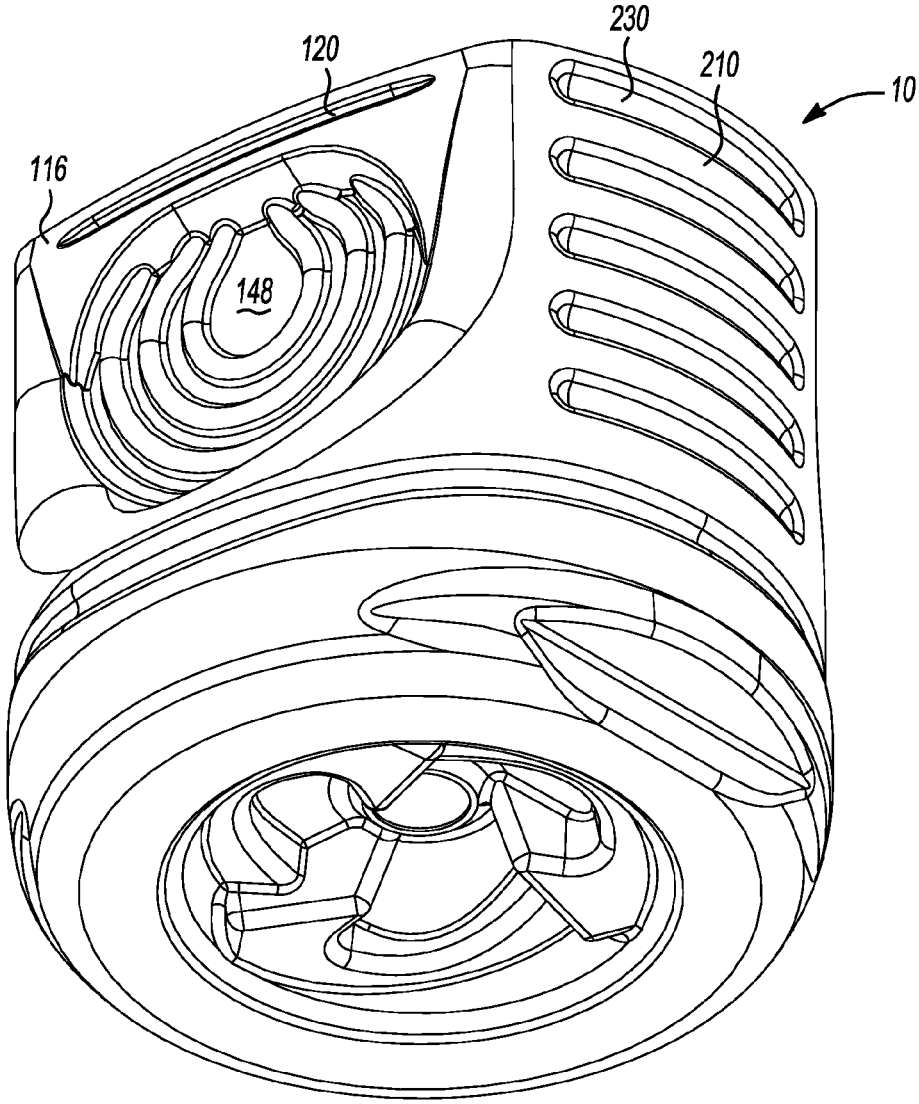
FIG. 6 is a bottom perspective, cross-sectional view of an exemplary container incorporating the features of the present teachings taken along line 4-4 of FIG. 3.

As shown in FIGS. 1-3, the exemplary plastic container 10 according to the present teachings defines a body 12, and includes an upper portion 14 having a cylindrical sidewall 18 forming a finish 20. Integrally formed with the finish 20 and extending downward therefrom is a shoulder portion 22. The shoulder portion 22 merges into and provides a transition between the finish 20 and a sidewall portion 24. The sidewall portion 24 extends downward from the shoulder portion 22 to a base portion 28 having a base 30. In some embodiments, sidewall portion 24 can extend down and nearly abut base 30, thereby minimizing the overall area of base portion 28 such that there is not a discernable base portion 28 when exemplary container 10 is uprightly-placed on a surface.

The exemplary container 10 may also have a neck 23. The neck 23 may have an extremely short height, that is, becoming a short extension from the finish 20, or an elongated height, extending between the finish 20 and the shoulder portion 22. The upper portion 14 can define an opening for filling and dispensing of a commodity stored therein. Although the container is shown as a beverage container, it should be appreciated that containers having different shapes, such as sidewalls and openings, can be made according to the principles of the present teachings.

The finish 20 of the exemplary plastic container 10 may include a threaded region 46 having threads 48, a lower sealing ridge 50, and a support ring 51. The threaded region provides a means for attachment of a similarly threaded closure or cap (not shown). Alternatives may include other suitable devices that engage the finish 20 of the exemplary plastic container 10, such as a press-fit or snap-fit cap for example. Accordingly, the closure or cap engages the finish 20 to preferably provide a hermetical seal of the exemplary plastic container 10. The closure or cap is preferably of a plastic or metal material conventional to the closure industry and suitable for subsequent thermal processing.

In some embodiments, the container 10 can comprise a label/vacuum panel area 100 generally disposed along sidewall portion 24. In some embodiments, panel area 100 can be disposed in other areas of the container 10, including the base portion 28 and/or shoulder portion 22. Panel area 100 can comprise a series or plurality of panel sections that generally resist fill pressure and maximize vacuum absorption without distorting. Generally, panel area 100 can be configured and disposed on opposing sides of container 10. In some embodiments, panel areas 100 can be disposed on opposing sides of a generally rectangular sidewall portion 24 when viewed in cross-section.

In some embodiments, each panel area 100 can comprise a generally oval boundary panel 110. Generally oval boundary panel 110 can include a plurality of smaller boundary tiles 112 that extend along the outer edge of generally oval boundary panel 110 and serve, at least in part, as a transition surface from sidewall lands 114 and the surfaces within panel area 100. In other words, as seen in FIGS. 1 and 2, boundary tiles 112 can define a generally curved or arcuate surface extending between and providing a smooth continuation from sidewall lands 114 to surfaces within panel area 100. It should be appreciated that although generally oval boundary panel 110 is described as having a plurality of boundary tiles 112, each of the plurality of boundary tiles 112 can be smoothly defined so as to seamlessly transition from one to the next to create a generally smooth, flowing, continuous, and uninterrupted boundary panel 110.

With continued reference to FIGS. 1-6, panel area 100 can further comprise a belt land portion 116 generally extending horizontally between opposing boundary tiles 112. Belt land portion 116 can intercept boundary tiles 112 generally along a transition edge 118, which in some embodiments can result in a generally converging set of intersecting lines. Belt land portion 116 can be generally flat when view from a side (such as FIG. 1), but also arcuate or otherwise curved when viewed from above or in cross section (such as FIGS. 4-6). This arcuate or otherwise curved shape, when viewed in cross section, provides increased hoop strength in the container 10 and further provides a continuous, uninterrupted diameter of container 10 (see FIGS. 4-6). This can be particularly useful for application of labels and the like and, moreover, provides increased structural rigidity. Belt land portion 116 can be shaped and/or configured to further extend along a label area. That is, belt land portion 116 can be sized and configured to be within the same plane as a later-applied label and thus help define a major diameter of container 10.

An inwardly-directed rib member 120 can be disposed within belt land portion 116 and extend horizontally therethrough. Rib member 120 can comprise a generally straight portion extending toward, but separate from transition edge 118 such that rib member 120 is completely contained within belt land portion 116. Rib member 120 can be sized to include a pair of inwardly directed surfaces 122 converging at an inner radius 124. Rib member 120 can be used to reduce and/or otherwise strengthen belt land portion 116 to prevent or at least minimize expansion under fill pressure.

Still referring to FIGS. 1-2, each panel area 100 can further comprising a pair of inset portions 130 disposed in mirrored relationship relative to inwardly-directed rib member 120 and/or belt land portion 116. The pair of inset portions 130 are configured to each move together with the other in response to vacuum and/or top loading forces. Additionally, in some embodiments, the pair of inset portions 130 can be used as vacuum panels and as grip panels—separately or in combination—as described herein. Still further, in some embodiments, the pair of inset portions 130 and belt land portion 116 can together move as a single unit in response to internal vacuum pressure.

In some embodiments, inset portions 130 can be configured and/or shaped as clamshell shaped features 130. Each of the clamshell shaped features 130 can comprise a plurality of generally circular, C-shaped, or horseshoe-shaped ribs 132, 134, 136, 138 generally radiating from a central point 140. Ribs 132, 134, 136, 138 can be outwardly-directed (see FIG. 1) such that they define inwardly-directed valleys 142, 144, 146 extending between adjacent ribs 132, 134, 136, 138. A central valley 148 can be disposed within central rib 132. The outermost rib 138 can transition to generally planar panel lands 150, which serve as transitions between each of the pair of clamshell shaped features and the generally oval boundary panel 110. Each of the pair of clamshell shaped features 130 provides stiffness to panel area 100 to control and/or equalize vacuum response over the entire panel area 100 and further serves to increase panel crystallinity. It should be appreciated, however, that alternative configurations of inset portions 130 can be used and are considered within the scope of the present disclosure. For example, inset portion 130 could be rectangular, oval, oblong, etc. Throughout the present disclosure, inset portion 130 and clamshell shaped features or portion 130 may be used interchangeably; however, it should be understood that the teachings of the present disclosure should not be regarded as being limited to the specific inset portion configuration described and illustrated herein.

A final transition surface 152 can be disposed along ends of ribs 132, 134, and at least 136 to provide a transition surface between ribs 132, 134, 136 and belt land portion 116.

With reference to FIGS. 1-3, in some embodiments, panel area 100 on opposing sides of container 10 can be offset relative to an axial centerline CL, such that a centerline PL of panel area 100 is not aligned with centerline CL. In this regard, container 10 can be sized such that a first side 210 of sidewall portion 24 of container 10 is narrower than an opposing second side 220. In this regard, sides 210 and/or 220 can be sized to facilitate gripping by a user. Moreover, sides 210 and/or 220 can be sized to facilitate gripping by a user having small hands (side 210) and by a user with large hands (side 220). Still further, sides 210 and/or 220 can be sized to permit gripping access of inset portions 130 by a user to permit inset portions 130 to be used as both vacuum absorbing features and grip features, simultaneously.

In some embodiments, a plurality of parallel, inwardly-directed ribs 230 can be formed throughout sides 210, 220 of sidewall portion 24. Ribs 230 can be provided to increase rigidity and strength of container 10. Ribs 230 can extend along and be contained by sides 210, 220, thereby not intersecting panel area 100. Distribution of ribs 230 has further been found to improve the structural integrity of container 10. Specifically, in some embodiments, it has been found that ribs 230 can be disposed parallel and equally spaced along sidewall portion 24.

Figure 7:
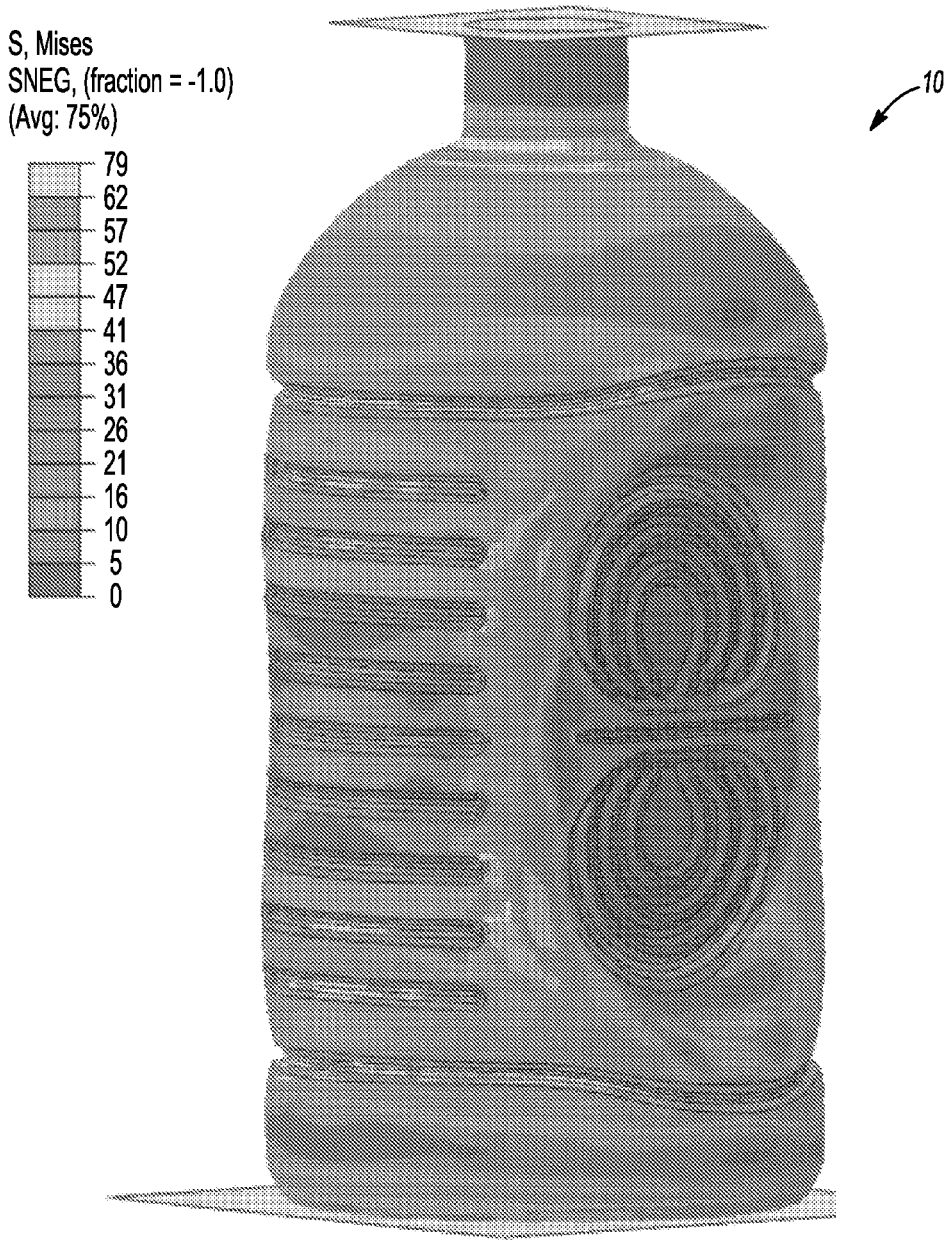
FIG. 7 is an image illustrate strain concentrations in an exemplary container incorporating the features of the present teachings.

With particular reference to FIGS. 1-3, container 10 can further comprise one or more inwardly-directed, circumferential ribs 310. In some embodiments, circumferential rib 310 can be disposed between or generally along an interface between shoulder portion 22 and sidewall portion 24, between or generally along an interface between base portion 28 and sidewall portion 24, or both. In some embodiments, circumferential rib 310 can define an arcuate path about container 10 such that a peak 312 is formed on opposing sides of container 10. More particularly, in some embodiments, peak 312 can be aligned with panel area 100 such that peak 312 is generally disposed directly above a central section of panel area 100 (see FIG. 2). It should be understood that peak 312 can similarly be a trough 312' formed below and aligned with panel area 100. In some embodiments, as seen in FIGS. 2 and 7, circumferential ribs 310 are formed above and below panel area 100 and serve to direct top loading forces to away from and around panel area 100, thereby resulting in top loading forces being absorbed and carried by sections 314 on opposing sides of panel area 100.

Circumferential ribs 310 can be formed to have an inward radiused section 316 for improved structural integrity and extending outwardly along a corresponding outward radiused section 318 to merge with sidewall lands 114, which can itself include various features and contours. Through their structure, circumferential ribs 310 are capable of resisting the force of internal pressure by acting as a "belt" that limits the "unfolding" of the cosmetic geometry of the container that makes up the exterior design.

The plastic container 10 of the present disclosure is a blow molded, biaxially oriented container with a unitary construction from a single or multi-layer material. A well-known stretch-molding, heat-setting process for making the one-piece plastic container 10 generally involves the manufacture of a preform (not shown) of a polyester material, such as polyethylene terephthalate (PET), having a shape well known to those skilled in the art similar to a test-tube with a generally cylindrical cross section. An exemplary method of manufacturing the plastic container 10 will be described in greater detail later.

An exemplary method of forming the container 10 will be described. A preform version of container 10 includes a support ring 51, which may be used to carry or orient the preform through and at various stages of manufacture. For example, the preform may be carried by the support ring, the support ring may be used to aid in positioning the preform in a mold cavity, or the support ring may be used to carry an intermediate container once molded. At the outset, the preform may be placed into the mold cavity such that the support ring is captured at an upper end of the mold cavity. In general, the mold cavity has an interior surface corresponding to a desired outer profile of the blown container. More specifically, the mold cavity according to the present teachings defines a body forming region, an optional moil forming region and an optional opening forming region. Once the resultant structure, hereinafter referred to as an intermediate container, has been formed, any moil created by the moil forming region may be severed and discarded. It should be appreciated that the use of a moil forming region and/or opening forming region are not necessarily in all forming methods.

In one example, a machine (not illustrated) places the preform heated to a temperature between approximately 190° F. to 250° F. (approximately 88° C. to 121° C.) into the mold cavity. The mold cavity may be heated to a temperature between approximately 250° F. to 350° F. (approximately 121° C. to 177° C.). A stretch rod apparatus (not illustrated) stretches or extends the heated preform within the mold cavity to a length approximately that of the intermediate container thereby molecularly orienting the polyester material in an axial direction generally corresponding with the central longitudinal axis of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the intermediate container. The pressurized air holds the mostly biaxial molecularly oriented polyester material against the mold cavity for a period of approximately two (2) to five (5) seconds before removal of the intermediate container from the mold cavity. This process is known as heat setting and results in a heat-resistant container suitable for filling with a product at high temperatures.

Alternatively, other manufacturing methods, such as for example, extrusion blow molding, one step injection stretch blow molding and injection blow molding, using other conventional materials including, for example, high density polyethylene, polypropylene, polyethylene naphthalate (PEN), a PET/PEN blend or copolymer, and various multi-layer structures may be suitable for the manufacture of plastic container 10. Those having ordinary skill in the art will readily know and understand plastic container manufacturing method alternatives.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A container comprising:
- a finish;
- a sidewall extending from said finish;
- a base extending from said sidewall and enclosing said sidewall to define a cavity for retaining a commodity; and
- a flexible panel disposed in said sidewall, said flexible panel including:
  - a belt land portion; and
  - a pair of inset portions each mirroring one another along said horizontal channel of said central panel and including:
    - a plurality of concentric ribs extending outward from the cavity and commonly disposed about a central recess; and
    - a plurality of concentric valleys extending inward toward the cavity and interspersed between said plurality of concentric ribs; and
  - a generally oval boundary area surrounding and containing said belt land portion and said pair of inset portions.

2. The container according to claim 1 wherein each of said plurality of ribs are generally C-shaped.

3. The container according to claim 1 wherein said ribs are within said belt land portion.

4. The container according to claim 1 wherein said generally oval boundary area comprises a transition surface between said pair of inset portions and adjacent lands extending along said sidewall.

5. The container according to claim 1 wherein each one of said pair of inset portions are clamshell-shaped.

6. The container according to claim 1 wherein said belt land portion defines a continuous, transition with adjacent sides of said sidewall.

7. The container according to claim 1 wherein said flexible panel flexes in response to vacuum forces.

8. The container according to claim 1 wherein said pair of inset portions further comprise a gripping surface that is flexible in response to vacuum forces.

* * * * *